US009828858B2

(12) United States Patent
Munoz et al.

(10) Patent No.: US 9,828,858 B2
(45) Date of Patent: Nov. 28, 2017

(54) TURBINE BLADE AIRFOIL AND TIP SHROUD

(71) Applicant: Siemens Energy, Inc., Orlando, FL (US)

(72) Inventors: Eric Munoz, Miami Gardens, FL (US); Edwin Lee Kite, Stuart, FL (US); John Pula, Jupiter, FL (US); Charles M. Evans, Tequesta, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 268 days.

(21) Appl. No.: 14/890,928

(22) PCT Filed: May 20, 2014

(86) PCT No.: PCT/US2014/038750

§ 371 (c)(1),
(2) Date: Nov. 13, 2015

(87) PCT Pub. No.: WO2014/189902

PCT Pub. Date: Nov. 27, 2014

(65) Prior Publication Data

US 2016/0115795 A1 Apr. 28, 2016

Related U.S. Application Data

(60) Provisional application No. 61/825,642, filed on May 21, 2013.

(51) Int. Cl.
*F01D 5/14* (2006.01)

(52) U.S. Cl.
CPC ..... *F01D 5/141* (2013.01); *F05D 2240/301* (2013.01); *F05D 2250/74* (2013.01)

(58) Field of Classification Search
None
See application file for complete search history.

(56) References Cited

U.S. PATENT DOCUMENTS

| | | | |
|---|---|---|---|
| 6,499,950 | B2 | 12/2002 | Willett et al. |
| 6,685,434 | B1 | 2/2004 | Humanchuk et al. |
| 6,761,534 | B1 | 7/2004 | Willett |
| 6,805,530 | B1 | 10/2004 | Urban |
| 6,832,897 | B2 | 12/2004 | Urban |
| 6,851,931 | B1 | 2/2005 | Tomberg |
| 6,857,853 | B1 | 2/2005 | Tomberg et al. |
| 6,881,038 | B1 | 4/2005 | Beddard et al. |
| 6,890,150 | B2 | 5/2005 | Tomberg |

(Continued)

FOREIGN PATENT DOCUMENTS

DE 102009003794 A1 10/2009

*Primary Examiner* — Dwayne J White
*Assistant Examiner* — Theodore Ribadeneyra

(57) ABSTRACT

A turbine blade airfoil (25, 31R, 31M, 31T, 72) comprising an outer surface shape defined by Cartesian coordinates of successive transverse profiles at radial increments as set forth in Tables 1a to 1k, wherein each table defines a transverse sectional profile characterized by a smooth curve connecting the coordinates, and the surface shape comprises a smooth surface connecting the sectional profiles. The blade may include a tip shroud with edge profiles defined by Cartesian coordinates set forth in Table 2a and 2b. A gusset/fillet may be provided between the blade airfoil and the tip shroud, with a planar diagonal surface over most of a diagonal bracing area of the gusset/fillet.

7 Claims, 3 Drawing Sheets

(56) References Cited

U.S. PATENT DOCUMENTS

| | | | |
|---|---|---|---|
| 6,893,216 | B2 | 5/2005 | Snook et al. |
| 6,910,864 | B2 | 6/2005 | Tomberg |
| 6,913,445 | B1 | 7/2005 | Beddard et al. |
| 6,997,679 | B2 | 2/2006 | Beddard et al. |
| 7,001,144 | B2 | 2/2006 | Urban et al. |
| 7,063,509 | B2 | 6/2006 | Snook et al. |
| 7,094,023 | B2 | 8/2006 | Dube et al. |
| 7,094,032 | B2 | 8/2006 | Seleski |
| 7,273,353 | B2 | 7/2007 | Dube et al. |
| 7,419,361 | B1 | 7/2008 | Byam et al. |
| 7,632,075 | B2 | 12/2009 | Liang et al. |
| 8,057,186 | B2 | 11/2011 | Brittingham |
| 8,192,168 | B2 | 6/2012 | Bonini et al. |
| 8,371,818 | B2 | 2/2013 | Brittingham et al. |
| 2005/0019160 | A1 | 1/2005 | Hyde et al. |
| 2011/0243748 | A1 | 10/2011 | Tsifourdaris |
| 2013/0064671 | A1 | 3/2013 | Herzlinger et al. |
| 2013/0071249 | A1 | 3/2013 | Collier et al. |
| 2013/0084169 | A1 | 4/2013 | Kareff et al. |

FIG 1
PRIOR ART
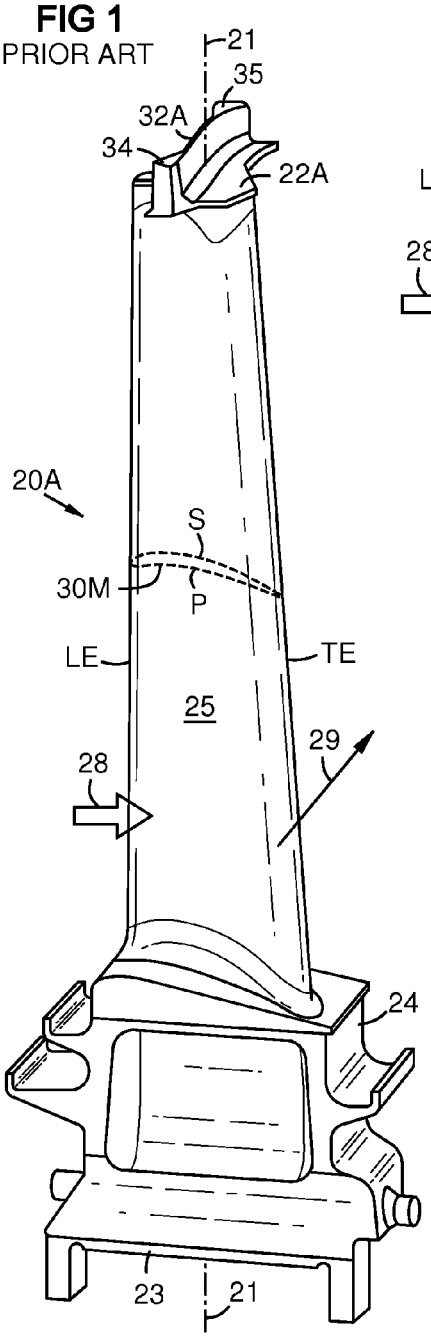
FIG 2
PRIOR ART
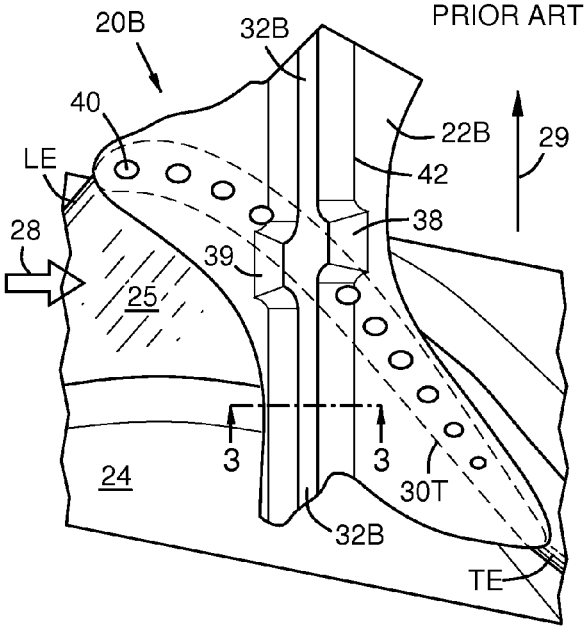
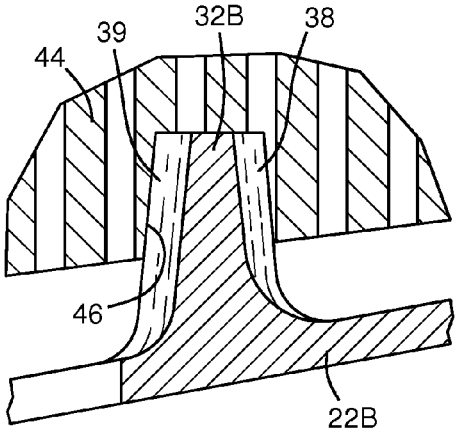
FIG 3
PRIOR ART

TURBINE BLADE AIRFOIL AND TIP SHROUD

CROSS REFERENCE TO RELATED APPLICATIONS

This application is the US National Stage of International Application No. PCT/US2014/038750 filed May 20, 2014, and claims the benefit thereof. The International Application claims benefit of the 21 May 2013 filing date of United States provisional patent application number 61/825,642. All applications are incorporated by reference herein.

FIELD OF THE INVENTION

The invention relates to turbine blade design, and particularly to gas turbine blade airfoil shape and tip shroud shape for maximum aerodynamic efficiency and structural life.

BACKGROUND OF THE INVENTION

In a gas turbine engine, air is pressurized in a compressor, then mixed with fuel and burned in a combustor to generate hot combustion gases. The hot combustion gases are expanded within the turbine section where energy is extracted to power the compressor and to produce useful work, such as turning a generator to produce electricity. The hot combustion gas, also called the working gas, travels through a series of turbine stages that are numbered starting at 1 from front to back of the turbine section. A turbine stage includes a circular array of rotating turbine blades, and may also include a circular array of stationary vanes. The blades extract energy from the working gas for powering the compressor and providing output power. Commonly, each blade is removably mounted on the circumference of a disk.

A turbine blade has a tip that closely clears a surrounding shroud. The shroud channels the working gas through the turbine section. The inner lining of the shroud is made abradable so the blade tips can cut a path in it to minimize the tip-to-shroud clearance, and minimize leakage of the working gas from the pressure side to the suction side of each blade. Some blade designs include a tip shroud as shown in FIG. 1. The shroud is a transverse plate on the blade tip. A seal rail may extend radially outward from the shroud. The term "radial" herein means along a radius from the turbine rotation axis. The rail is aligned circumferentially with the rotation direction. It cuts a narrow groove in the shroud lining for working gas sealing. The rail may include wider portions called teeth that cut the groove wider than the rail to minimize friction. Cantilevered portions of the tip shroud must be rigid to resist flexing from centrifugal force.

BRIEF DESCRIPTION OF THE DRAWINGS

The invention is explained in the following description in view of the drawings that show:

FIG. 1 is a perspective view of a prior art turbine blade with a tip shroud.

FIG. 2 is a top view of a prior art tip shroud and seal rail.

FIG. 3 is a sectional view taken on line 3-3 of FIG. 2.

DETAILED DESCRIPTION OF THE INVENTION

Figure 4A:
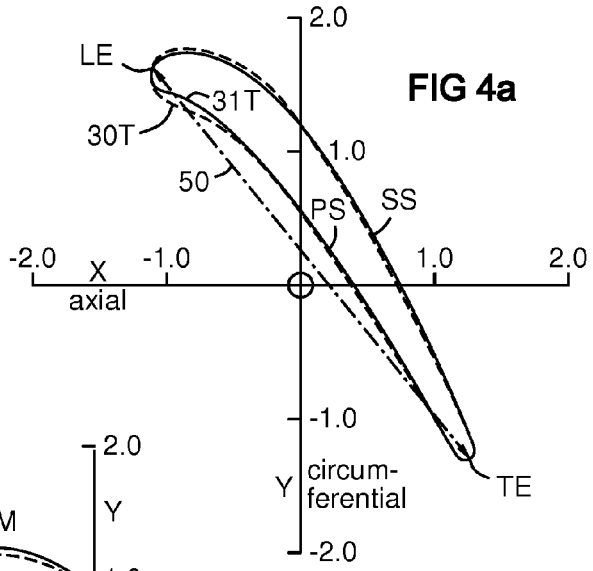
FIG. 4*a* is a transverse sectional profile of a blade tip, showing a prior art airfoil profile in dashed line and an embodiment of the invention in solid line.

FIG. 1 shows a prior art gas turbine blade 20A with a tip shroud 22A. The blade has a root 23, a platform 24, and an airfoil 25 with a leading edge LE and a trailing edge TE. A transverse profile 30M of the airfoil midsection is shown with a pressure side P and a suction side S. An axial direction 28 of the working gas flow and a circumferential direction 29 of blade rotation are shown. "Axial" means parallel to the turbine rotation axis. The circumferentially oriented seal rail 32A has wider portions or teeth 34, 35 for cutting a groove in the shroud liner. The root 23, platform 24, and airfoil 25 may have respective centers of mass stacked along a stacking axis 21, which is a radial line from the turbine rotation axis when the blade is installed.

FIG. 2 is a top view of another prior art turbine blade 20B showing a tip shroud 22B, a platform 24, and an airfoil 25 with a leading edge LE and a trailing edge TE. A transverse profile 30T of the airfoil tip is shown with a dashed line. An axial direction 28 of the working gas flow and a circumferential direction 29 of blade rotation are shown. A circumferentially oriented seal rail 32B has first and second teeth 38, 39 for cutting a groove in the shroud liner. Cooling air outlets 40 pass through the tip shroud from cooling chambers in the airfoil 25. The rail and teeth have fillets 42.

FIG. 3 is a sectional view taken on line 3-3 of FIG. 2, showing an abradable shroud liner 44 with a groove 46 therein that is cut by the teeth 38, 39 on the seal rail 32B. Abradable shroud liners are often made of ceramic that may be porous and/or may have a honeycomb structure to increase abradability. Gas leakage over the blade tip is impeded by the seal rail 32B in the groove 46.

The present inventors have recognized a need for blades with an improved tip shroud and transitional structure between the airfoil and the tip shroud in order to reduce mechanical loading at the blade airfoil inner radial span and root regions, reduce tip shroud deflection, reduce aerodynamic losses, improved turbine efficiency and power generation, and increase blade tip thermo-mechanical fatigue life compared to known blade configurations.

FIG. 4*a* is a transverse sectional profile of a blade tip, showing a prior art airfoil profile in dashed line and a replacement profile of an embodiment of the invention in solid line. A leading edge LE, trailing edge TE, pressure side PS, suction side SS, and chord line 50 of the replacement profile are shown. The replacement profile has a leading edge portion that may be at least 5% narrower in the front 20% of the chord length compared to the prior art profile.

Figure 4B:
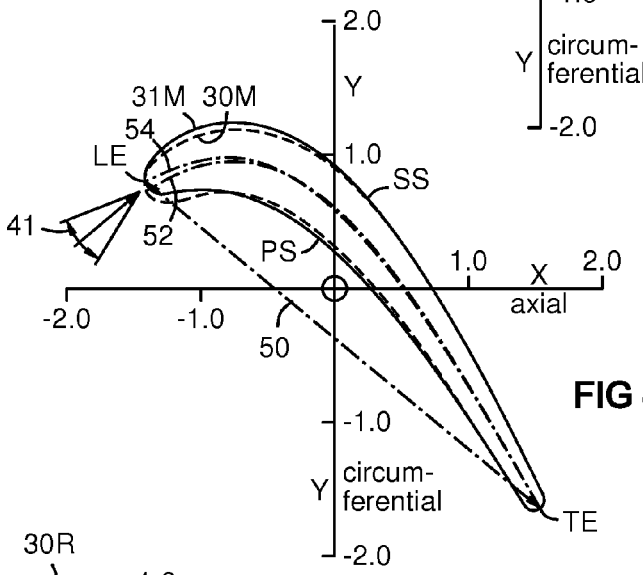
FIG. 4*b* is a transverse sectional profile of a spanwise midpoint of a blade, showing a prior art airfoil profile in dashed line and an embodiment of the invention in solid line.

FIG. 4*b* is a transverse sectional profile of a midsection of a blade at 50% span, showing a prior art airfoil profile in dashed line and a replacement profile of an embodiment of the invention in solid line. A chord line 50 is shown. Mean camber lines 52, 54 of the respective prior art and inventive profiles are shown. The replacement profile may have at least 3 degrees less camber in the front 15% of the chord length compared to the prior art profile. This means the angular divergence between the respective mean camber lines 52, 54 of the prior art and inventive blades may be at least 3 degrees at a chord position of greatest angular divergence there between within the front 15% of the chord length. The inventive profile may also have at least 3% narrower leading edge portion in the front 10% of the chord length compared to the prior art profile.

Figure 4C:
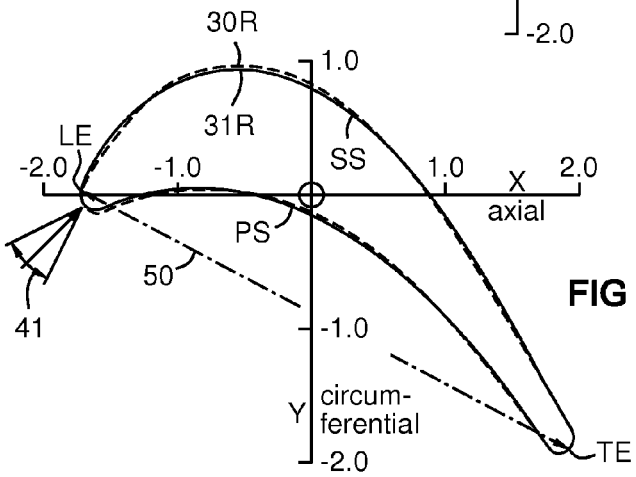
FIG. 4*c* is a transverse section of a blade root, showing a prior art airfoil profile in dashed line and an embodiment of the invention in solid line.

FIG. 4*c* is a transverse section of a blade root, showing a prior art airfoil profile in dashed line and a replacement profile of an embodiment of the invention in solid line. A chord line 36 of the replacement profile is shown. The replacement profile may have at least 1 degree less camber in the front 25% of the chord length compared to the prior art profile.

A blade airfoil conforming to the replacement profiles 31T, 31M, and 31R provides the following aerodynamic improvements over the prior art blade of profiles 31T, 30M, 30R:

a) Increased tolerance to variations 41 in the angle of incidence of the working gas inflow at the leading edge of the airfoil.

b) Substantially reduced suction surface diffusion over most of the span of the blade. Suction surface diffusion is the increase in static pressure from airfoil trailing edge to a minimum static pressure location of the blade suction surface divided by velocity head (Pt-Ps) at the minimum pressure location.

c) Reduction in aerodynamic losses on the suction side of the airfoil, due to reduced friction on the airfoil surfaces.

d) Reduced peak Mach number in the trailing edge region, resulting in reduced trailing edge losses and increased aerodynamic efficiency.

e) Improved mass distribution resulting in reduced structural loading in the lower span and root of the blade.

Tables 1a-1k herein specify eleven sectional profiles of a blade airfoil according to an embodiment of the invention at successive 10% radial increments of the span of the airfoil starting at the root. The absolute values of the coordinates define one blade in inches. However, the coordinates may used as relative values that may be scaled up or down proportionally, along with the tolerance below, for larger or smaller turbines. Each radial profile is characterized by a smooth curve connecting the nominal X and Y coordinates in each table. The term "nominal" herein means a design goal implemented within acceptable tolerance. An acceptable manufacturing tolerance is +/−0.050 inches in a direction normal to the surface at each location at a temperature of 20° C. (293.15 K, 68° F.). The coordinates represent the uncoated outer surface of the airfoil. The airfoil surface is a smooth surface connecting the sectional profiles defined below from 0% to 100% of the span.

TABLE 1a

| 0% Radial Span | |
|---|---|
| X (Axial) | Y (Circum.) |
| −1.680 | −0.091 |
| −1.719 | −0.021 |
| −1.702 | 0.095 |
| −1.670 | 0.167 |
| −1.612 | 0.271 |
| −1.570 | 0.338 |
| −1.525 | 0.402 |
| −1.450 | 0.494 |
| −1.397 | 0.552 |
| −1.310 | 0.633 |

TABLE 1a-continued

| 0% Radial Span | |
|---|---|
| X (Axial) | Y (Circum.) |
| −1.250 | 0.684 |
| −1.186 | 0.731 |
| −1.086 | 0.794 |
| −1.016 | 0.830 |
| −0.906 | 0.875 |
| −0.831 | 0.899 |
| −0.754 | 0.916 |
| −0.637 | 0.932 |
| −0.558 | 0.936 |
| −0.440 | 0.930 |
| −0.361 | 0.919 |
| −0.284 | 0.902 |
| −0.171 | 0.868 |
| −0.097 | 0.839 |
| 0.010 | 0.789 |
| 0.079 | 0.751 |
| 0.147 | 0.710 |
| 0.245 | 0.644 |
| 0.309 | 0.597 |
| 0.401 | 0.523 |
| 0.460 | 0.471 |
| 0.518 | 0.417 |
| 0.601 | 0.333 |
| 0.655 | 0.276 |
| 0.734 | 0.187 |
| 0.784 | 0.126 |
| 0.834 | 0.065 |
| 0.906 | −0.029 |
| 0.952 | −0.093 |
| 1.021 | −0.190 |
| 1.065 | −0.255 |
| 1.109 | −0.321 |
| 1.174 | −0.420 |
| 1.216 | −0.486 |
| 1.258 | −0.554 |
| 1.319 | −0.655 |
| 1.360 | −0.722 |
| 1.400 | −0.791 |
| 1.459 | −0.893 |
| 1.498 | −0.962 |
| 1.556 | −1.065 |
| 1.594 | −1.134 |
| 1.632 | −1.203 |
| 1.688 | −1.308 |
| 1.725 | −1.378 |
| 1.784 | −1.480 |
| 1.824 | −1.548 |
| 1.862 | −1.617 |
| 1.893 | −1.668 |
| 1.913 | −1.702 |
| 1.933 | −1.736 |
| 1.951 | −1.771 |
| 1.956 | −1.790 |
| 1.957 | −1.830 |
| 1.953 | −1.849 |
| 1.936 | −1.884 |
| 1.916 | −1.906 |
| 1.891 | −1.922 |
| 1.853 | −1.933 |
| 1.833 | −1.933 |
| 1.806 | −1.923 |
| 1.784 | −1.903 |
| 1.765 | −1.880 |
| 1.747 | −1.856 |
| 1.730 | −1.832 |
| 1.719 | −1.816 |
| 1.702 | −1.792 |
| 1.691 | −1.775 |
| 1.657 | −1.727 |
| 1.623 | −1.678 |
| 1.554 | −1.582 |
| 1.508 | −1.518 |
| 1.461 | −1.454 |
| 1.389 | −1.360 |
| 1.340 | −1.298 |

TABLE 1a-continued

| 0% Radial Span | |
|---|---|
| X (Axial) | Y (Circum.) |
| 1.265 | −1.206 |
| 1.215 | −1.146 |
| 1.163 | −1.086 |
| 1.084 | −0.998 |
| 1.030 | −0.940 |
| 0.949 | −0.854 |
| 0.893 | −0.798 |
| 0.836 | −0.744 |
| 0.749 | −0.663 |
| 0.690 | −0.611 |
| 0.599 | −0.535 |
| 0.537 | −0.486 |
| 0.474 | −0.439 |
| 0.377 | −0.371 |
| 0.311 | −0.327 |
| 0.211 | −0.265 |
| 0.142 | −0.226 |
| 0.072 | −0.188 |
| −0.034 | −0.136 |
| −0.106 | −0.104 |
| −0.216 | −0.061 |
| −0.291 | −0.036 |
| −0.367 | −0.014 |
| −0.482 | 0.013 |
| −0.560 | 0.027 |
| −0.677 | 0.042 |
| −0.756 | 0.048 |
| −0.835 | 0.050 |
| −0.953 | 0.047 |
| −1.032 | 0.041 |
| −1.149 | 0.025 |
| −1.227 | 0.010 |
| −1.304 | −0.009 |
| −1.417 | −0.042 |
| −1.491 | −0.072 |
| −1.603 | −0.110 |
| −1.680 | −0.091 |

TABLE 1b

| 10% Radial Span | |
|---|---|
| X (Axial) | Y (Circum.) |
| −1.608 | 0.120 |
| −1.639 | 0.190 |
| −1.627 | 0.303 |
| −1.599 | 0.373 |
| −1.541 | 0.471 |
| −1.495 | 0.532 |
| −1.445 | 0.589 |
| −1.364 | 0.669 |
| −1.305 | 0.718 |
| −1.212 | 0.784 |
| −1.147 | 0.823 |
| −1.080 | 0.857 |
| −0.974 | 0.901 |
| −0.902 | 0.923 |
| −0.790 | 0.947 |
| −0.715 | 0.956 |
| −0.639 | 0.959 |
| −0.525 | 0.954 |
| −0.450 | 0.944 |
| −0.339 | 0.920 |
| −0.266 | 0.897 |
| −0.195 | 0.871 |
| −0.091 | 0.824 |
| −0.024 | 0.788 |
| 0.073 | 0.729 |
| 0.136 | 0.686 |
| 0.197 | 0.641 |

TABLE 1b-continued

| 10% Radial Span | |
|---|---|
| X (Axial) | Y (Circum.) |
| 0.285 | 0.569 |
| 0.342 | 0.519 |
| 0.425 | 0.440 |
| 0.478 | 0.386 |
| 0.530 | 0.331 |
| 0.606 | 0.246 |
| 0.655 | 0.188 |
| 0.727 | 0.099 |
| 0.773 | 0.039 |
| 0.819 | −0.022 |
| 0.886 | −0.114 |
| 0.929 | −0.176 |
| 0.993 | −0.271 |
| 1.035 | −0.334 |
| 1.077 | −0.398 |
| 1.138 | −0.494 |
| 1.178 | −0.558 |
| 1.217 | −0.623 |
| 1.276 | −0.721 |
| 1.314 | −0.787 |
| 1.352 | −0.852 |
| 1.408 | −0.951 |
| 1.445 | −1.018 |
| 1.500 | −1.118 |
| 1.536 | −1.184 |
| 1.572 | −1.251 |
| 1.625 | −1.352 |
| 1.660 | −1.420 |
| 1.712 | −1.521 |
| 1.738 | −1.572 |
| 1.764 | −1.623 |
| 1.773 | −1.640 |
| 1.790 | −1.673 |
| 1.803 | −1.698 |
| 1.817 | −1.724 |
| 1.831 | −1.759 |
| 1.835 | −1.787 |
| 1.831 | −1.815 |
| 1.819 | −1.841 |
| 1.799 | −1.862 |
| 1.775 | −1.876 |
| 1.747 | −1.882 |
| 1.719 | −1.879 |
| 1.693 | −1.867 |
| 1.672 | −1.848 |
| 1.654 | −1.826 |
| 1.632 | −1.795 |
| 1.621 | −1.779 |
| 1.600 | −1.748 |
| 1.578 | −1.716 |
| 1.557 | −1.685 |
| 1.515 | −1.622 |
| 1.451 | −1.528 |
| 1.408 | −1.465 |
| 1.364 | −1.403 |
| 1.298 | −1.310 |
| 1.253 | −1.249 |
| 1.208 | −1.188 |
| 1.139 | −1.097 |
| 1.093 | −1.037 |
| 1.046 | −0.977 |
| 0.974 | −0.888 |
| 0.925 | −0.830 |
| 0.851 | −0.744 |
| 0.801 | −0.687 |
| 0.750 | −0.631 |
| 0.671 | −0.548 |
| 0.618 | −0.493 |
| 0.537 | −0.414 |
| 0.481 | −0.362 |
| 0.425 | −0.311 |
| 0.338 | −0.237 |
| 0.279 | −0.189 |
| 0.188 | −0.120 |
| 0.126 | −0.077 |

TABLE 1b-continued

| 10% Radial Span | |
|---|---|
| X (Axial) | Y (Circum.) |
| 0.063 | −0.035 |
| −0.035 | 0.023 |
| −0.102 | 0.059 |
| −0.206 | 0.107 |
| −0.276 | 0.135 |
| −0.348 | 0.160 |
| −0.458 | 0.190 |
| −0.532 | 0.206 |
| −0.645 | 0.221 |
| −0.721 | 0.226 |
| −0.797 | 0.227 |
| −0.911 | 0.222 |
| −0.986 | 0.213 |
| −1.098 | 0.194 |
| −1.172 | 0.177 |
| −1.246 | 0.158 |
| −1.355 | 0.125 |
| −1.427 | 0.102 |
| −1.540 | 0.085 |
| −1.608 | 0.120 |

TABLE 1c

| 20% Radial Span | |
|---|---|
| X (Axial) | Y (Circum.) |
| −1.522 | 0.255 |
| −1.572 | 0.311 |
| −1.577 | 0.421 |
| −1.552 | 0.491 |
| −1.495 | 0.587 |
| −1.451 | 0.646 |
| −1.401 | 0.702 |
| −1.319 | 0.777 |
| −1.261 | 0.823 |
| −1.168 | 0.884 |
| −1.103 | 0.919 |
| −1.035 | 0.949 |
| −0.965 | 0.975 |
| −0.858 | 1.003 |
| −0.784 | 1.015 |
| −0.673 | 1.022 |
| −0.599 | 1.020 |
| −0.525 | 1.012 |
| −0.416 | 0.992 |
| −0.345 | 0.972 |
| −0.240 | 0.934 |
| −0.172 | 0.904 |
| −0.106 | 0.870 |
| −0.010 | 0.814 |
| 0.052 | 0.772 |
| 0.141 | 0.706 |
| 0.198 | 0.659 |
| 0.254 | 0.610 |
| 0.335 | 0.534 |
| 0.388 | 0.481 |
| 0.463 | 0.400 |
| 0.512 | 0.344 |
| 0.560 | 0.288 |
| 0.630 | 0.201 |
| 0.675 | 0.142 |
| 0.742 | 0.053 |
| 0.785 | −0.007 |
| 0.828 | −0.068 |
| 0.890 | −0.160 |
| 0.931 | −0.222 |
| 0.992 | −0.315 |
| 1.031 | −0.378 |
| 1.070 | −0.441 |
| 1.128 | −0.536 |

TABLE 1c-continued

| 20% Radial Span | |
|---|---|
| X (Axial) | Y (Circum.) |
| 1.166 | −0.600 |
| 1.223 | −0.696 |
| 1.259 | −0.760 |
| 1.296 | −0.825 |
| 1.350 | −0.922 |
| 1.386 | −0.987 |
| 1.438 | −1.085 |
| 1.473 | −1.151 |
| 1.508 | −1.216 |
| 1.559 | −1.315 |
| 1.593 | −1.381 |
| 1.627 | −1.447 |
| 1.661 | −1.513 |
| 1.686 | −1.563 |
| 1.703 | −1.596 |
| 1.720 | −1.629 |
| 1.728 | −1.645 |
| 1.744 | −1.678 |
| 1.756 | −1.704 |
| 1.763 | −1.731 |
| 1.761 | −1.768 |
| 1.754 | −1.785 |
| 1.730 | −1.813 |
| 1.706 | −1.827 |
| 1.679 | −1.832 |
| 1.651 | −1.829 |
| 1.626 | −1.817 |
| 1.599 | −1.791 |
| 1.588 | −1.776 |
| 1.568 | −1.745 |
| 1.553 | −1.722 |
| 1.538 | −1.698 |
| 1.518 | −1.667 |
| 1.498 | −1.636 |
| 1.458 | −1.574 |
| 1.396 | −1.481 |
| 1.355 | −1.419 |
| 1.313 | −1.358 |
| 1.250 | −1.266 |
| 1.208 | −1.206 |
| 1.143 | −1.115 |
| 1.099 | −1.055 |
| 1.055 | −0.995 |
| 0.988 | −0.907 |
| 0.943 | −0.848 |
| 0.874 | −0.760 |
| 0.828 | −0.702 |
| 0.781 | −0.645 |
| 0.709 | −0.560 |
| 0.661 | −0.504 |
| 0.586 | −0.421 |
| 0.536 | −0.367 |
| 0.484 | −0.313 |
| 0.406 | −0.234 |
| 0.352 | −0.183 |
| 0.270 | −0.108 |
| 0.213 | −0.060 |
| 0.156 | −0.014 |
| 0.067 | 0.053 |
| 0.005 | 0.095 |
| −0.089 | 0.154 |
| −0.154 | 0.189 |
| −0.221 | 0.222 |
| −0.289 | 0.252 |
| −0.393 | 0.290 |
| −0.465 | 0.311 |
| −0.573 | 0.334 |
| −0.647 | 0.345 |
| −0.721 | 0.351 |
| −0.832 | 0.351 |
| −0.906 | 0.347 |
| −1.017 | 0.334 |
| −1.090 | 0.321 |
| −1.162 | 0.306 |
| −1.270 | 0.278 |

TABLE 1c-continued

| 20% Radial Span | |
|---|---|
| X (Axial) | Y (Circum.) |
| −1.341 | 0.256 |
| −1.450 | 0.236 |
| −1.522 | 0.255 |

TABLE 1d

| 30% Radial Span | |
|---|---|
| X (Axial) | Y (Circum.) |
| −1.514 | 0.450 |
| −1.530 | 0.522 |
| −1.495 | 0.624 |
| −1.458 | 0.686 |
| −1.391 | 0.772 |
| −1.341 | 0.824 |
| −1.287 | 0.872 |
| −1.199 | 0.937 |
| −1.137 | 0.974 |
| −1.039 | 1.022 |
| −0.971 | 1.047 |
| −0.901 | 1.067 |
| −0.794 | 1.086 |
| −0.722 | 1.092 |
| −0.650 | 1.091 |
| −0.541 | 1.081 |
| −0.470 | 1.068 |
| −0.400 | 1.049 |
| −0.297 | 1.014 |
| −0.231 | 0.985 |
| −0.134 | 0.935 |
| −0.072 | 0.898 |
| −0.012 | 0.858 |
| 0.076 | 0.793 |
| 0.132 | 0.747 |
| 0.213 | 0.675 |
| 0.265 | 0.625 |
| 0.316 | 0.573 |
| 0.390 | 0.493 |
| 0.437 | 0.438 |
| 0.507 | 0.355 |
| 0.552 | 0.298 |
| 0.596 | 0.240 |
| 0.660 | 0.152 |
| 0.702 | 0.093 |
| 0.764 | 0.004 |
| 0.804 | −0.056 |
| 0.844 | −0.117 |
| 0.903 | −0.208 |
| 0.941 | −0.270 |
| 0.998 | −0.362 |
| 1.036 | −0.425 |
| 1.073 | −0.487 |
| 1.127 | −0.581 |
| 1.163 | −0.644 |
| 1.217 | −0.739 |
| 1.252 | −0.802 |
| 1.286 | −0.866 |
| 1.320 | −0.930 |
| 1.371 | −1.026 |
| 1.405 | −1.090 |
| 1.455 | −1.187 |
| 1.488 | −1.251 |
| 1.521 | −1.316 |
| 1.570 | −1.413 |
| 1.602 | −1.477 |
| 1.619 | −1.510 |
| 1.635 | −1.542 |
| 1.651 | −1.575 |
| 1.659 | −1.591 |
| 1.675 | −1.623 |

TABLE 1d-continued

| 30% Radial Span | |
|---|---|
| X (Axial) | Y (Circum.) |
| 1.692 | −1.656 |
| 1.697 | −1.673 |
| 1.697 | −1.709 |
| 1.687 | −1.735 |
| 1.669 | −1.755 |
| 1.637 | −1.772 |
| 1.619 | −1.775 |
| 1.584 | −1.769 |
| 1.561 | −1.755 |
| 1.542 | −1.734 |
| 1.522 | −1.704 |
| 1.508 | −1.681 |
| 1.494 | −1.658 |
| 1.474 | −1.628 |
| 1.455 | −1.597 |
| 1.435 | −1.566 |
| 1.396 | −1.506 |
| 1.356 | −1.445 |
| 1.297 | −1.354 |
| 1.257 | −1.293 |
| 1.216 | −1.233 |
| 1.155 | −1.143 |
| 1.114 | −1.084 |
| 1.051 | −0.995 |
| 1.009 | −0.936 |
| 0.966 | −0.877 |
| 0.902 | −0.790 |
| 0.858 | −0.732 |
| 0.792 | −0.645 |
| 0.748 | −0.588 |
| 0.703 | −0.532 |
| 0.634 | −0.447 |
| 0.588 | −0.392 |
| 0.516 | −0.309 |
| 0.468 | −0.255 |
| 0.419 | −0.202 |
| 0.344 | −0.123 |
| 0.293 | −0.072 |
| 0.214 | 0.003 |
| 0.160 | 0.051 |
| 0.104 | 0.098 |
| 0.019 | 0.165 |
| −0.040 | 0.207 |
| −0.132 | 0.266 |
| −0.194 | 0.302 |
| −0.259 | 0.336 |
| −0.358 | 0.380 |
| −0.426 | 0.405 |
| −0.495 | 0.426 |
| −0.602 | 0.449 |
| −0.673 | 0.460 |
| −0.746 | 0.466 |
| −0.854 | 0.467 |
| −0.927 | 0.464 |
| −1.035 | 0.452 |
| −1.106 | 0.441 |
| −1.177 | 0.427 |
| −1.283 | 0.400 |
| −1.354 | 0.384 |
| −1.460 | 0.401 |
| −1.514 | 0.450 |

TABLE 1e

| 40% Radial Span | |
|---|---|
| X (Axial) | Y (Circum.) |
| −1.447 | 0.592 |
| −1.475 | 0.657 |
| −1.446 | 0.758 |

TABLE 1e-continued

| 40% Radial Span | |
|---|---|
| X (Axial) | Y (Circum.) |
| −1.409 | 0.818 |
| −1.341 | 0.900 |
| −1.290 | 0.948 |
| −1.235 | 0.992 |
| −1.145 | 1.049 |
| −1.083 | 1.082 |
| −1.017 | 1.109 |
| −0.916 | 1.139 |
| −0.846 | 1.153 |
| −0.776 | 1.160 |
| −0.670 | 1.161 |
| −0.600 | 1.155 |
| −0.496 | 1.136 |
| −0.427 | 1.117 |
| −0.361 | 1.094 |
| −0.263 | 1.052 |
| −0.201 | 1.019 |
| −0.110 | 0.965 |
| −0.052 | 0.925 |
| 0.005 | 0.882 |
| 0.087 | 0.815 |
| 0.139 | 0.767 |
| 0.215 | 0.693 |
| 0.264 | 0.642 |
| 0.311 | 0.590 |
| 0.380 | 0.510 |
| 0.425 | 0.455 |
| 0.490 | 0.371 |
| 0.532 | 0.315 |
| 0.574 | 0.258 |
| 0.615 | 0.200 |
| 0.675 | 0.112 |
| 0.714 | 0.054 |
| 0.772 | −0.035 |
| 0.810 | −0.095 |
| 0.847 | −0.155 |
| 0.903 | −0.245 |
| 0.939 | −0.305 |
| 0.993 | −0.397 |
| 1.029 | −0.458 |
| 1.064 | −0.519 |
| 1.116 | −0.612 |
| 1.150 | −0.673 |
| 1.201 | −0.766 |
| 1.234 | −0.829 |
| 1.267 | −0.891 |
| 1.316 | −0.985 |
| 1.348 | −1.048 |
| 1.396 | −1.143 |
| 1.428 | −1.206 |
| 1.460 | −1.269 |
| 1.507 | −1.364 |
| 1.531 | −1.411 |
| 1.554 | −1.459 |
| 1.570 | −1.490 |
| 1.577 | −1.506 |
| 1.593 | −1.538 |
| 1.608 | −1.570 |
| 1.616 | −1.586 |
| 1.628 | −1.619 |
| 1.628 | −1.654 |
| 1.622 | −1.671 |
| 1.600 | −1.698 |
| 1.569 | −1.714 |
| 1.551 | −1.716 |
| 1.517 | −1.708 |
| 1.495 | −1.692 |
| 1.478 | −1.672 |
| 1.459 | −1.642 |
| 1.445 | −1.619 |
| 1.431 | −1.597 |
| 1.413 | −1.567 |
| 1.394 | −1.537 |
| 1.375 | −1.507 |
| 1.337 | −1.448 |

TABLE 1e-continued

| 40% Radial Span | |
|---|---|
| X (Axial) | Y (Circum.) |
| 1.279 | −1.359 |
| 1.241 | −1.299 |
| 1.202 | −1.240 |
| 1.144 | −1.152 |
| 1.105 | −1.093 |
| 1.045 | −1.005 |
| 1.005 | −0.947 |
| 0.965 | −0.889 |
| 0.903 | −0.802 |
| 0.862 | −0.745 |
| 0.821 | −0.688 |
| 0.758 | −0.603 |
| 0.715 | −0.546 |
| 0.672 | −0.490 |
| 0.607 | −0.406 |
| 0.563 | −0.351 |
| 0.496 | −0.269 |
| 0.450 | −0.215 |
| 0.404 | −0.162 |
| 0.333 | −0.083 |
| 0.285 | −0.032 |
| 0.210 | 0.044 |
| 0.160 | 0.094 |
| 0.108 | 0.142 |
| 0.028 | 0.211 |
| −0.027 | 0.256 |
| −0.111 | 0.320 |
| −0.170 | 0.360 |
| −0.229 | 0.397 |
| −0.322 | 0.449 |
| −0.385 | 0.480 |
| −0.483 | 0.520 |
| −0.551 | 0.542 |
| −0.619 | 0.561 |
| −0.723 | 0.581 |
| −0.793 | 0.589 |
| −0.864 | 0.594 |
| −0.970 | 0.593 |
| −1.040 | 0.588 |
| −1.110 | 0.579 |
| −1.214 | 0.560 |
| −1.283 | 0.544 |
| −1.389 | 0.551 |
| −1.447 | 0.592 |

TABLE 1f

| 50% Radial Span | |
|---|---|
| X (Axial) | Y (Circum.) |
| −1.376 | 0.742 |
| −1.414 | 0.800 |
| −1.401 | 0.902 |
| −1.365 | 0.961 |
| −1.296 | 1.038 |
| −1.243 | 1.082 |
| −1.186 | 1.121 |
| −1.126 | 1.155 |
| −1.030 | 1.195 |
| −0.964 | 1.215 |
| −0.862 | 1.234 |
| −0.794 | 1.240 |
| −0.724 | 1.240 |
| −0.621 | 1.230 |
| −0.554 | 1.218 |
| −0.454 | 1.189 |
| −0.389 | 1.165 |
| −0.326 | 1.137 |
| −0.235 | 1.089 |
| −0.176 | 1.052 |

TABLE 1f-continued

| 50% Radial Span | |
|---|---|
| X (Axial) | Y (Circum.) |
| −0.091 | 0.993 |
| −0.036 | 0.951 |
| 0.016 | 0.906 |
| 0.093 | 0.836 |
| 0.141 | 0.787 |
| 0.189 | 0.737 |
| 0.258 | 0.660 |
| 0.302 | 0.607 |
| 0.345 | 0.553 |
| 0.409 | 0.471 |
| 0.450 | 0.416 |
| 0.510 | 0.332 |
| 0.550 | 0.275 |
| 0.588 | 0.218 |
| 0.645 | 0.132 |
| 0.683 | 0.074 |
| 0.738 | −0.014 |
| 0.775 | −0.073 |
| 0.811 | −0.131 |
| 0.864 | −0.220 |
| 0.899 | −0.280 |
| 0.951 | −0.369 |
| 0.985 | −0.429 |
| 1.019 | −0.490 |
| 1.069 | −0.580 |
| 1.102 | −0.641 |
| 1.134 | −0.702 |
| 1.183 | −0.793 |
| 1.215 | −0.855 |
| 1.246 | −0.916 |
| 1.293 | −1.008 |
| 1.324 | −1.070 |
| 1.370 | −1.163 |
| 1.401 | −1.225 |
| 1.432 | −1.287 |
| 1.462 | −1.348 |
| 1.485 | −1.395 |
| 1.500 | −1.426 |
| 1.515 | −1.457 |
| 1.530 | −1.488 |
| 1.542 | −1.511 |
| 1.554 | −1.534 |
| 1.565 | −1.567 |
| 1.565 | −1.593 |
| 1.557 | −1.618 |
| 1.535 | −1.644 |
| 1.503 | −1.658 |
| 1.486 | −1.660 |
| 1.453 | −1.652 |
| 1.426 | −1.630 |
| 1.416 | −1.616 |
| 1.397 | −1.587 |
| 1.379 | −1.558 |
| 1.365 | −1.536 |
| 1.351 | −1.514 |
| 1.333 | −1.485 |
| 1.305 | −1.441 |
| 1.278 | −1.397 |
| 1.222 | −1.310 |
| 1.185 | −1.252 |
| 1.148 | −1.194 |
| 1.091 | −1.107 |
| 1.054 | −1.049 |
| 0.996 | −0.963 |
| 0.958 | −0.905 |
| 0.919 | −0.848 |
| 0.860 | −0.763 |
| 0.821 | −0.706 |
| 0.761 | −0.622 |
| 0.721 | −0.566 |
| 0.680 | −0.510 |
| 0.618 | −0.427 |
| 0.577 | −0.372 |
| 0.534 | −0.317 |
| 0.470 | −0.236 |

TABLE 1f-continued

| 50% Radial Span | |
|---|---|
| X (Axial) | Y (Circum.) |
| 0.427 | −0.182 |
| 0.382 | −0.129 |
| 0.315 | −0.051 |
| 0.269 | 0.001 |
| 0.199 | 0.077 |
| 0.151 | 0.127 |
| 0.103 | 0.176 |
| 0.028 | 0.248 |
| −0.023 | 0.295 |
| −0.101 | 0.362 |
| −0.155 | 0.405 |
| −0.210 | 0.447 |
| −0.295 | 0.506 |
| −0.353 | 0.543 |
| −0.444 | 0.594 |
| −0.505 | 0.625 |
| −0.569 | 0.652 |
| −0.666 | 0.687 |
| −0.733 | 0.706 |
| −0.834 | 0.727 |
| −0.903 | 0.735 |
| −0.972 | 0.738 |
| −1.041 | 0.737 |
| −1.144 | 0.728 |
| −1.212 | 0.718 |
| −1.315 | 0.709 |
| −1.376 | 0.742 |

TABLE 1g

| 60% Radial Span | |
|---|---|
| X (Axial) | Y (Circum.) |
| −1.354 | 0.955 |
| −1.361 | 1.023 |
| −1.317 | 1.114 |
| −1.271 | 1.164 |
| −1.191 | 1.226 |
| −1.132 | 1.259 |
| −1.069 | 1.286 |
| −0.972 | 1.314 |
| −0.905 | 1.326 |
| −0.838 | 1.332 |
| −0.736 | 1.330 |
| −0.669 | 1.321 |
| −0.602 | 1.308 |
| −0.505 | 1.280 |
| −0.441 | 1.256 |
| −0.349 | 1.212 |
| −0.290 | 1.179 |
| −0.232 | 1.144 |
| −0.149 | 1.085 |
| −0.096 | 1.043 |
| −0.019 | 0.976 |
| 0.030 | 0.930 |
| 0.078 | 0.882 |
| 0.147 | 0.807 |
| 0.191 | 0.756 |
| 0.234 | 0.704 |
| 0.297 | 0.624 |
| 0.338 | 0.570 |
| 0.378 | 0.515 |
| 0.437 | 0.432 |
| 0.476 | 0.376 |
| 0.532 | 0.292 |
| 0.569 | 0.235 |
| 0.606 | 0.178 |
| 0.659 | 0.092 |
| 0.695 | 0.034 |
| 0.748 | −0.053 |

TABLE 1g-continued

| 60% Radial Span | |
|---|---|
| X (Axial) | Y (Circum.) |
| 0.782 | −0.111 |
| 0.816 | −0.170 |
| 0.867 | −0.258 |
| 0.900 | −0.317 |
| 0.950 | −0.406 |
| 0.982 | −0.465 |
| 1.015 | −0.525 |
| 1.047 | −0.585 |
| 1.094 | −0.675 |
| 1.125 | −0.735 |
| 1.171 | −0.825 |
| 1.202 | −0.886 |
| 1.232 | −0.947 |
| 1.277 | −1.038 |
| 1.307 | −1.099 |
| 1.351 | −1.190 |
| 1.381 | −1.251 |
| 1.411 | −1.312 |
| 1.425 | −1.343 |
| 1.440 | −1.373 |
| 1.455 | −1.404 |
| 1.470 | −1.434 |
| 1.481 | −1.457 |
| 1.493 | −1.479 |
| 1.506 | −1.511 |
| 1.507 | −1.545 |
| 1.498 | −1.568 |
| 1.482 | −1.588 |
| 1.452 | −1.604 |
| 1.418 | −1.606 |
| 1.402 | −1.601 |
| 1.375 | −1.581 |
| 1.355 | −1.554 |
| 1.337 | −1.525 |
| 1.328 | −1.511 |
| 1.310 | −1.482 |
| 1.291 | −1.454 |
| 1.273 | −1.425 |
| 1.255 | −1.396 |
| 1.219 | −1.339 |
| 1.164 | −1.253 |
| 1.128 | −1.196 |
| 1.092 | −1.139 |
| 1.037 | −1.053 |
| 1.000 | −0.996 |
| 0.964 | −0.939 |
| 0.908 | −0.854 |
| 0.871 | −0.797 |
| 0.833 | −0.741 |
| 0.777 | −0.656 |
| 0.739 | −0.600 |
| 0.681 | −0.517 |
| 0.641 | −0.461 |
| 0.602 | −0.406 |
| 0.542 | −0.324 |
| 0.501 | −0.270 |
| 0.440 | −0.189 |
| 0.398 | −0.136 |
| 0.356 | −0.083 |
| 0.292 | −0.004 |
| 0.248 | 0.048 |
| 0.204 | 0.100 |
| 0.136 | 0.176 |
| 0.090 | 0.225 |
| 0.044 | 0.274 |
| −0.028 | 0.347 |
| −0.077 | 0.394 |
| −0.152 | 0.462 |
| −0.203 | 0.507 |
| −0.255 | 0.550 |
| −0.336 | 0.612 |
| −0.391 | 0.651 |
| −0.476 | 0.706 |
| −0.535 | 0.740 |
| −0.595 | 0.772 |

TABLE 1g-continued

| 60% Radial Span | |
|---|---|
| X (Axial) | Y (Circum.) |
| −0.688 | 0.813 |
| −0.752 | 0.836 |
| −0.850 | 0.864 |
| −0.916 | 0.876 |
| −0.984 | 0.883 |
| −1.051 | 0.885 |
| −1.153 | 0.880 |
| −1.220 | 0.870 |
| −1.316 | 0.898 |
| −1.354 | 0.955 |

TABLE 1h

| 70% Radial Span | |
|---|---|
| X (Axial) | Y (Circum.) |
| −1.290 | 1.098 |
| −1.305 | 1.163 |
| −1.270 | 1.256 |
| −1.223 | 1.303 |
| −1.141 | 1.359 |
| −1.080 | 1.387 |
| −1.017 | 1.407 |
| −0.952 | 1.421 |
| −0.852 | 1.429 |
| −0.786 | 1.427 |
| −0.687 | 1.414 |
| −0.622 | 1.399 |
| −0.558 | 1.380 |
| −0.466 | 1.343 |
| −0.406 | 1.314 |
| −0.319 | 1.265 |
| −0.263 | 1.228 |
| −0.209 | 1.189 |
| −0.131 | 1.127 |
| −0.081 | 1.083 |
| −0.033 | 1.037 |
| 0.037 | 0.966 |
| 0.083 | 0.918 |
| 0.127 | 0.868 |
| 0.190 | 0.791 |
| 0.231 | 0.739 |
| 0.292 | 0.659 |
| 0.331 | 0.605 |
| 0.369 | 0.551 |
| 0.425 | 0.468 |
| 0.462 | 0.413 |
| 0.516 | 0.329 |
| 0.552 | 0.273 |
| 0.587 | 0.216 |
| 0.639 | 0.131 |
| 0.673 | 0.074 |
| 0.707 | 0.016 |
| 0.757 | −0.070 |
| 0.789 | −0.128 |
| 0.822 | −0.186 |
| 0.870 | −0.273 |
| 0.902 | −0.332 |
| 0.949 | −0.420 |
| 0.980 | −0.479 |
| 1.010 | −0.538 |
| 1.056 | −0.627 |
| 1.086 | −0.686 |
| 1.130 | −0.776 |
| 1.159 | −0.836 |
| 1.189 | −0.895 |
| 1.217 | −0.955 |
| 1.261 | −1.045 |
| 1.289 | −1.105 |
| 1.332 | −1.195 |

TABLE 1h-continued

| 70% Radial Span | |
|---|---|
| X (Axial) | Y (Circum.) |
| 1.353 | −1.241 |
| 1.375 | −1.286 |
| 1.389 | −1.316 |
| 1.403 | −1.346 |
| 1.414 | −1.368 |
| 1.424 | −1.391 |
| 1.439 | −1.421 |
| 1.450 | −1.452 |
| 1.448 | −1.486 |
| 1.442 | −1.501 |
| 1.421 | −1.526 |
| 1.391 | −1.540 |
| 1.357 | −1.540 |
| 1.334 | −1.530 |
| 1.315 | −1.514 |
| 1.296 | −1.487 |
| 1.279 | −1.458 |
| 1.265 | −1.437 |
| 1.252 | −1.416 |
| 1.235 | −1.388 |
| 1.217 | −1.359 |
| 1.191 | −1.317 |
| 1.165 | −1.274 |
| 1.112 | −1.189 |
| 1.078 | −1.133 |
| 1.043 | −1.076 |
| 0.991 | −0.991 |
| 0.956 | −0.934 |
| 0.903 | −0.850 |
| 0.867 | −0.793 |
| 0.832 | −0.737 |
| 0.778 | −0.653 |
| 0.742 | −0.597 |
| 0.687 | −0.514 |
| 0.650 | −0.459 |
| 0.613 | −0.403 |
| 0.575 | −0.348 |
| 0.518 | −0.266 |
| 0.480 | −0.212 |
| 0.422 | −0.131 |
| 0.382 | −0.077 |
| 0.342 | −0.024 |
| 0.281 | 0.055 |
| 0.240 | 0.107 |
| 0.177 | 0.185 |
| 0.135 | 0.236 |
| 0.091 | 0.286 |
| 0.025 | 0.361 |
| −0.021 | 0.410 |
| −0.067 | 0.458 |
| −0.137 | 0.528 |
| −0.185 | 0.574 |
| −0.234 | 0.619 |
| −0.310 | 0.684 |
| −0.362 | 0.726 |
| −0.441 | 0.786 |
| −0.496 | 0.824 |
| −0.553 | 0.859 |
| −0.640 | 0.908 |
| −0.700 | 0.937 |
| −0.793 | 0.974 |
| −0.856 | 0.993 |
| −0.921 | 1.009 |
| −1.020 | 1.023 |
| −1.086 | 1.027 |
| −1.152 | 1.025 |
| −1.249 | 1.044 |
| −1.290 | 1.098 |

TABLE 1i

| 80% Radial Span | |
|---|---|
| X (Axial) | Y (Circum.) |
| −1.243 | 1.298 |
| −1.232 | 1.363 |
| −1.168 | 1.436 |
| −1.113 | 1.471 |
| −1.022 | 1.507 |
| −0.958 | 1.521 |
| −0.893 | 1.528 |
| −0.827 | 1.528 |
| −0.730 | 1.517 |
| −0.666 | 1.503 |
| −0.573 | 1.473 |
| −0.512 | 1.448 |
| −0.453 | 1.420 |
| −0.368 | 1.371 |
| −0.313 | 1.335 |
| −0.234 | 1.278 |
| −0.184 | 1.236 |
| −0.134 | 1.193 |
| −0.063 | 1.126 |
| −0.017 | 1.079 |
| 0.027 | 1.032 |
| 0.092 | 0.958 |
| 0.134 | 0.908 |
| 0.175 | 0.857 |
| 0.234 | 0.779 |
| 0.273 | 0.726 |
| 0.330 | 0.646 |
| 0.366 | 0.592 |
| 0.403 | 0.538 |
| 0.456 | 0.456 |
| 0.491 | 0.400 |
| 0.542 | 0.317 |
| 0.576 | 0.261 |
| 0.609 | 0.205 |
| 0.642 | 0.148 |
| 0.691 | 0.063 |
| 0.723 | 0.006 |
| 0.770 | −0.080 |
| 0.801 | −0.137 |
| 0.832 | −0.195 |
| 0.878 | −0.282 |
| 0.908 | −0.340 |
| 0.952 | −0.427 |
| 0.982 | −0.486 |
| 1.011 | −0.544 |
| 1.054 | −0.632 |
| 1.082 | −0.691 |
| 1.110 | −0.750 |
| 1.152 | −0.839 |
| 1.180 | −0.898 |
| 1.207 | −0.957 |
| 1.248 | −1.047 |
| 1.275 | −1.106 |
| 1.302 | −1.166 |
| 1.322 | −1.210 |
| 1.336 | −1.240 |
| 1.349 | −1.270 |
| 1.363 | −1.299 |
| 1.373 | −1.322 |
| 1.383 | −1.344 |
| 1.395 | −1.374 |
| 1.398 | −1.407 |
| 1.386 | −1.437 |
| 1.375 | −1.450 |
| 1.347 | −1.467 |
| 1.315 | −1.471 |
| 1.284 | −1.460 |
| 1.260 | −1.437 |
| 1.252 | −1.424 |
| 1.235 | −1.395 |
| 1.218 | −1.367 |
| 1.202 | −1.339 |
| 1.185 | −1.311 |
| 1.168 | −1.283 |
| 1.152 | −1.255 |

TABLE 1i-continued

| 80% Radial Span | |
|---|---|
| X (Axial) | Y (Circum.) |
| 1.118 | −1.199 |
| 1.085 | −1.143 |
| 1.035 | −1.058 |
| 1.001 | −1.002 |
| 0.968 | −0.946 |
| 0.917 | −0.862 |
| 0.883 | −0.806 |
| 0.832 | −0.722 |
| 0.798 | −0.667 |
| 0.764 | −0.611 |
| 0.712 | −0.528 |
| 0.677 | −0.473 |
| 0.624 | −0.390 |
| 0.589 | −0.335 |
| 0.553 | −0.280 |
| 0.499 | −0.198 |
| 0.463 | −0.144 |
| 0.426 | −0.090 |
| 0.370 | −0.010 |
| 0.332 | 0.043 |
| 0.294 | 0.096 |
| 0.235 | 0.175 |
| 0.195 | 0.227 |
| 0.135 | 0.304 |
| 0.094 | 0.355 |
| 0.052 | 0.405 |
| −0.012 | 0.480 |
| −0.055 | 0.528 |
| −0.122 | 0.600 |
| −0.167 | 0.647 |
| −0.214 | 0.694 |
| −0.261 | 0.739 |
| −0.334 | 0.804 |
| −0.384 | 0.846 |
| −0.461 | 0.906 |
| −0.514 | 0.945 |
| −0.569 | 0.981 |
| −0.653 | 1.031 |
| −0.711 | 1.061 |
| −0.800 | 1.101 |
| −0.862 | 1.123 |
| −0.925 | 1.141 |
| −1.021 | 1.160 |
| −1.086 | 1.166 |
| −1.151 | 1.173 |
| −1.226 | 1.235 |
| −1.243 | 1.298 |

TABLE 1j

| 90% Radial Span | |
|---|---|
| X (Axial) | Y (Circum.) |
| −1.179 | 1.430 |
| −1.170 | 1.494 |
| −1.105 | 1.564 |
| −1.049 | 1.595 |
| −0.957 | 1.622 |
| −0.893 | 1.629 |
| −0.829 | 1.629 |
| −0.765 | 1.623 |
| −0.671 | 1.602 |
| −0.610 | 1.583 |
| −0.521 | 1.545 |
| −0.464 | 1.516 |
| −0.409 | 1.483 |
| −0.329 | 1.430 |
| −0.278 | 1.391 |
| −0.204 | 1.330 |
| −0.156 | 1.287 |

TABLE 1j-continued

| 90% Radial Span | |
|---|---|
| X (Axial) | Y (Circum.) |
| −0.110 | 1.242 |
| −0.065 | 1.197 |
| 0.000 | 1.126 |
| 0.042 | 1.077 |
| 0.103 | 1.003 |
| 0.142 | 0.952 |
| 0.181 | 0.901 |
| 0.238 | 0.823 |
| 0.275 | 0.771 |
| 0.329 | 0.691 |
| 0.364 | 0.638 |
| 0.399 | 0.584 |
| 0.433 | 0.529 |
| 0.483 | 0.447 |
| 0.516 | 0.393 |
| 0.565 | 0.310 |
| 0.597 | 0.254 |
| 0.629 | 0.198 |
| 0.676 | 0.114 |
| 0.706 | 0.058 |
| 0.752 | −0.027 |
| 0.782 | −0.084 |
| 0.811 | −0.141 |
| 0.841 | −0.198 |
| 0.884 | −0.284 |
| 0.913 | −0.341 |
| 0.955 | −0.427 |
| 0.983 | −0.485 |
| 1.010 | −0.543 |
| 1.051 | −0.630 |
| 1.078 | −0.688 |
| 1.118 | −0.776 |
| 1.145 | −0.834 |
| 1.171 | −0.893 |
| 1.197 | −0.951 |
| 1.237 | −1.039 |
| 1.262 | −1.098 |
| 1.275 | −1.127 |
| 1.288 | −1.157 |
| 1.301 | −1.186 |
| 1.314 | −1.216 |
| 1.327 | −1.245 |
| 1.340 | −1.274 |
| 1.349 | −1.305 |
| 1.348 | −1.337 |
| 1.338 | −1.359 |
| 1.322 | −1.377 |
| 1.293 | −1.390 |
| 1.261 | −1.391 |
| 1.232 | −1.378 |
| 1.211 | −1.354 |
| 1.195 | −1.326 |
| 1.178 | −1.298 |
| 1.166 | −1.278 |
| 1.153 | −1.257 |
| 1.137 | −1.230 |
| 1.121 | −1.202 |
| 1.096 | −1.161 |
| 1.072 | −1.119 |
| 1.024 | −1.036 |
| 0.992 | −0.980 |
| 0.960 | −0.925 |
| 0.912 | −0.841 |
| 0.879 | −0.786 |
| 0.830 | −0.703 |
| 0.797 | −0.648 |
| 0.764 | −0.593 |
| 0.714 | −0.511 |
| 0.680 | −0.457 |
| 0.647 | −0.402 |
| 0.595 | −0.321 |
| 0.561 | −0.267 |
| 0.526 | −0.213 |
| 0.474 | −0.132 |
| 0.438 | −0.078 |

TABLE 1j-continued

| 90% Radial Span | |
|---|---|
| X (Axial) | Y (Circum.) |
| 0.385 | 0.002 |
| 0.349 | 0.055 |
| 0.312 | 0.107 |
| 0.257 | 0.186 |
| 0.219 | 0.238 |
| 0.181 | 0.289 |
| 0.123 | 0.366 |
| 0.084 | 0.417 |
| 0.044 | 0.468 |
| −0.016 | 0.542 |
| −0.057 | 0.592 |
| −0.120 | 0.665 |
| −0.162 | 0.713 |
| −0.206 | 0.760 |
| −0.273 | 0.829 |
| −0.318 | 0.874 |
| −0.365 | 0.918 |
| −0.437 | 0.982 |
| −0.486 | 1.023 |
| −0.537 | 1.063 |
| −0.615 | 1.119 |
| −0.668 | 1.154 |
| −0.752 | 1.202 |
| −0.809 | 1.231 |
| −0.868 | 1.255 |
| −0.929 | 1.276 |
| −1.022 | 1.300 |
| −1.085 | 1.312 |
| −1.163 | 1.367 |
| −1.179 | 1.430 |

TABLE 1k

| 100% Radial Span | |
|---|---|
| X (Axial) | Y (Circum.) |
| −1.114 | 1.549 |
| −1.109 | 1.613 |
| −1.050 | 1.685 |
| −0.994 | 1.713 |
| −0.933 | 1.730 |
| −0.839 | 1.738 |
| −0.777 | 1.733 |
| −0.715 | 1.721 |
| −0.624 | 1.693 |
| −0.566 | 1.669 |
| −0.482 | 1.626 |
| −0.429 | 1.593 |
| −0.376 | 1.558 |
| −0.302 | 1.501 |
| −0.253 | 1.460 |
| −0.207 | 1.418 |
| −0.140 | 1.352 |
| −0.096 | 1.306 |
| −0.054 | 1.259 |
| 0.007 | 1.187 |
| 0.046 | 1.138 |
| 0.104 | 1.063 |
| 0.141 | 1.013 |
| 0.178 | 0.961 |
| 0.231 | 0.884 |
| 0.266 | 0.831 |
| 0.318 | 0.752 |
| 0.351 | 0.699 |
| 0.384 | 0.645 |
| 0.417 | 0.591 |
| 0.465 | 0.510 |
| 0.496 | 0.456 |
| 0.543 | 0.374 |
| 0.574 | 0.319 |

TABLE 1k-continued

| 100% Radial Span | |
|---|---|
| X (Axial) | Y (Circum.) |
| 0.604 | 0.264 |
| 0.649 | 0.181 |
| 0.679 | 0.125 |
| 0.723 | 0.042 |
| 0.752 | −0.014 |
| 0.780 | −0.070 |
| 0.809 | −0.127 |
| 0.851 | −0.211 |
| 0.879 | −0.268 |
| 0.919 | −0.353 |
| 0.947 | −0.410 |
| 0.973 | −0.467 |
| 1.013 | −0.552 |
| 1.039 | −0.609 |
| 1.078 | −0.695 |
| 1.104 | −0.753 |
| 1.129 | −0.810 |
| 1.167 | −0.897 |
| 1.192 | −0.955 |
| 1.216 | −1.013 |
| 1.228 | −1.042 |
| 1.246 | −1.086 |
| 1.252 | −1.100 |
| 1.264 | −1.129 |
| 1.276 | −1.159 |
| 1.287 | −1.188 |
| 1.296 | −1.218 |
| 1.297 | −1.249 |
| 1.290 | −1.272 |
| 1.275 | −1.290 |
| 1.248 | −1.306 |
| 1.217 | −1.308 |
| 1.188 | −1.296 |
| 1.171 | −1.280 |
| 1.156 | −1.261 |
| 1.140 | −1.234 |
| 1.124 | −1.207 |
| 1.108 | −1.180 |
| 1.092 | −1.153 |
| 1.076 | −1.126 |
| 1.060 | −1.098 |
| 1.029 | −1.044 |
| 0.982 | −0.962 |
| 0.951 | −0.907 |
| 0.920 | −0.852 |
| 0.873 | −0.770 |
| 0.842 | −0.716 |
| 0.810 | −0.661 |
| 0.762 | −0.580 |
| 0.730 | −0.526 |
| 0.697 | −0.472 |
| 0.648 | −0.392 |
| 0.614 | −0.338 |
| 0.564 | −0.258 |
| 0.531 | −0.205 |
| 0.497 | −0.152 |
| 0.445 | −0.073 |
| 0.411 | −0.020 |
| 0.358 | 0.058 |
| 0.323 | 0.110 |
| 0.287 | 0.162 |
| 0.252 | 0.214 |
| 0.197 | 0.291 |
| 0.160 | 0.342 |
| 0.105 | 0.418 |
| 0.067 | 0.469 |
| 0.029 | 0.519 |
| −0.028 | 0.594 |
| −0.067 | 0.643 |
| −0.126 | 0.717 |
| −0.166 | 0.766 |
| −0.206 | 0.814 |
| −0.268 | 0.886 |
| −0.310 | 0.933 |
| −0.353 | 0.979 |

TABLE 1k-continued

| 100% Radial Span | |
|---|---|
| X (Axial) | Y (Circum.) |
| −0.418 | 1.047 |
| −0.462 | 1.092 |
| −0.508 | 1.135 |
| −0.577 | 1.199 |
| −0.626 | 1.239 |
| −0.701 | 1.297 |
| −0.753 | 1.332 |
| −0.807 | 1.364 |
| −0.863 | 1.393 |
| −0.949 | 1.430 |
| −1.011 | 1.446 |
| −1.093 | 1.489 |
| −1.114 | 1.549 |

Figure 5:
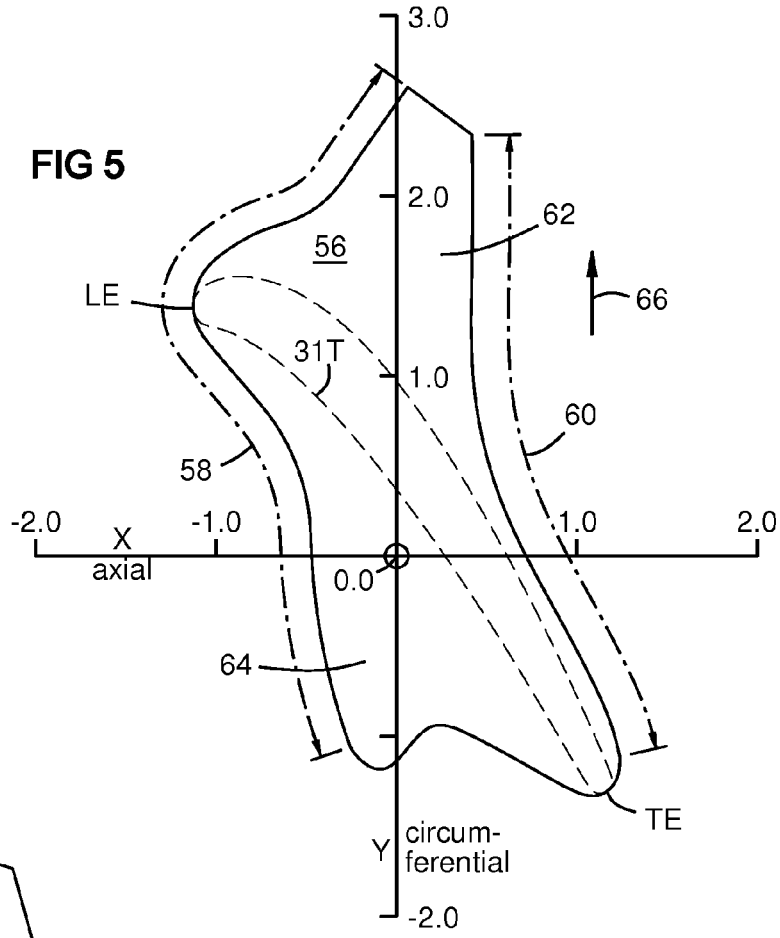
FIG. 5 is a top view of a turbine blade tip shroud 56 according to an embodiment of the invention with an underlying blade tip profile 31T.

FIG. 5 is a top view of a turbine blade tip shroud 56 according to an embodiment of the invention, showing an underlying blade tip profile 31T. This shape minimizes tip shroud stress and improves the tip shroud life over a prior art tip shroud by smoother curves. It also shifts mass toward the stacking axis compared to the prior art tip shroud. The shroud has a cantilevered front overhang 62 and a back overhang 64 relative to the rotation direction 66.

Table 2a specifies the shape of an axially forward edge of the tip shroud along the portion spanned by line 58. Table 2b specifies the shape of an axially aft edge profile spanned by line 60. The absolute values of the coordinates in inches define one airfoil. However, the coordinates may used as relative values that can be scaled up or down proportionally, along with the tolerance below, for larger or smaller turbines. Each profile 58, 60 is characterized by a smooth curve connecting the nominal X and Y coordinates in each table. An acceptable manufacturing tolerance is +/−0.050 inches in a direction normal to the tip shroud edge at each location at a temperature of 20° C. (293.15 K, 68° F.). The coordinates represent the uncoated outer surface of the tip shroud. The X (axial), Y (circumferential) origin 0.0 of the coordinates for tables 2a, 2b is on the same turbine radius with the X, Y origins of tables 1a-1k. The Z or radial coordinate depends on the radius of the turbine shroud inner surface. The radially outer surface of the tip shroud 56 may form a cylindrical or conical surface of rotation parallel to that of the turbine shroud inner surface. The specified shape may be scaled circumferentially for turbines with fewer or more blades per disk, such that the tip shrouds have close clearance in the circular array of blades.

TABLE 2a

| Leading-Edge Profile | |
|---|---|
| X (Axial) | Y (Circum.) |
| −0.271 | −1.114 |
| −0.328 | −0.942 |
| −0.377 | −0.768 |
| −0.418 | −0.593 |
| −0.451 | −0.417 |
| −0.475 | −0.239 |
| −0.492 | −0.059 |
| −0.501 | 0.122 |
| −0.520 | 0.301 |
| −0.564 | 0.475 |
| −0.633 | 0.641 |
| −0.724 | 0.794 |
| −0.835 | 0.934 |

TABLE 2a-continued

| Leading-Edge Profile | |
|---|---|
| X (Axial) | Y (Circum.) |
| −0.951 | 1.069 |
| −1.067 | 1.205 |
| −1.165 | 1.353 |
| −1.179 | 1.530 |
| −1.098 | 1.688 |
| −0.960 | 1.802 |
| −0.805 | 1.889 |
| −0.638 | 1.947 |
| −0.479 | 2.025 |
| −0.349 | 2.146 |
| −0.245 | 2.293 |
| −0.142 | 2.440 |
| −0.039 | 2.588 |
| 0.064 | 2.735 |

TABLE 2b

| Trailing-Edge Profile | |
|---|---|
| X (Axial) | Y (Circum.) |
| 0.440 | 2.457 |
| 0.440 | 2.298 |
| 0.440 | 2.139 |
| 0.440 | 1.981 |
| 0.440 | 1.822 |
| 0.440 | 1.663 |
| 0.440 | 1.504 |
| 0.440 | 1.345 |
| 0.440 | 1.186 |
| 0.447 | 1.028 |
| 0.465 | 0.871 |
| 0.492 | 0.715 |
| 0.529 | 0.562 |
| 0.576 | 0.411 |
| 0.633 | 0.262 |
| 0.699 | 0.117 |
| 0.772 | −0.024 |
| 0.845 | −0.164 |
| 0.918 | −0.304 |
| 0.991 | −0.445 |
| 1.064 | −0.585 |
| 1.137 | −0.725 |
| 1.207 | −0.869 |
| 1.261 | −1.018 |
| 1.301 | −1.172 |
| 1.324 | −1.328 |
| 1.331 | −1.486 |

Figure 6:
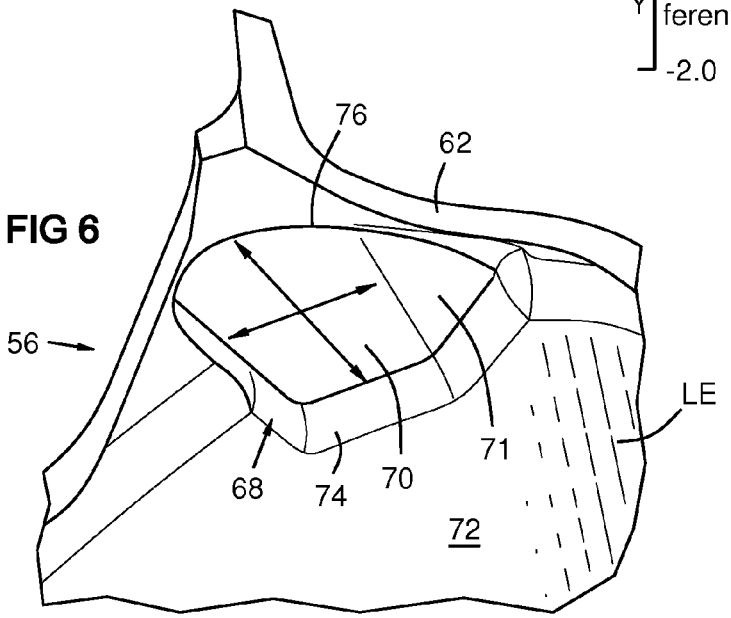
FIG. 6 is a perspective view of a gusset/fillet between a tip shroud and a blade airfoil according to a further embodiment of the invention.

FIG. 6 is a perspective view of a fillet between a tip shroud 56 and a blade according to a further embodiment of the invention. For comparison, patent U.S. Pat. No. 6,857,853 B1 shows a stage 2 blade design with a curved fillet between the tip shroud and blade. The present inventors recognized that the fillet could be improved to increased stiffness in the tip shroud to oppose bending from centrifugal force on one or both cantilevered overhangs 62, 64 (FIG. 5). A gusset/fillet 68 in an embodiment of the invention is shown with a planar surface 70 over most of a diagonal bracing area (arrows) and two planar side facets 71 that merge with the blade airfoil 72 via a continuous fillet 74, and merge with the tip shroud 56 along a generally semicircular or semi-elliptical line 76. This shape maximizes stiffness while minimizing stress concentration and mass.

While various embodiments of the present invention have been shown and described herein, it will be obvious that such embodiments are provided by way of example only.

Numerous variations, changes and substitutions may be made without departing from the invention herein. Accordingly, it is intended that the invention be limited only by the spirit and scope of the appended claims.

The invention claimed is:

1. A turbine blade airfoil comprising an outer surface shape defined by Cartesian coordinate values of X and Y at successive radial increments as set forth in Tables 1a to 1k, wherein each said table defines a transverse sectional profile characterized by a smooth curve connecting the X and Y coordinates, and the surface shape comprises a smooth surface connecting the sectional profiles.

2. The turbine blade airfoil of claim 1, wherein the Cartesian coordinate values are absolute values in inches, and a manufacturing tolerance of the smooth surface is +/−0.050 inches measured normal to said surface.

3. The turbine blade airfoil of claim 1, wherein the Cartesian coordinate values are relative values, and a manufacturing tolerance of the smooth surface is a relative value of +/−0.050 inches measured normal to said surface.

4. The turbine blade airfoil of claim 1, further comprising a tip shroud comprising an axially forward edge profile defined by Cartesian coordinate values of X and Y set forth in Table 2a, and an axially aft edge profile defined by Cartesian coordinate values of X and Y set forth in table 2b.

5. The turbine blade airfoil of claim 4, wherein the Cartesian coordinate values are absolute values in inches, and a manufacturing tolerance of the axially forward and aft profiles is +/−0.050 inches measured normal to said profiles.

6. The turbine blade airfoil of claim 4, wherein the Cartesian coordinate values are relative values, and a manufacturing tolerance of the axially forward and aft profiles is a relative value of +/−0.050 inches measured normal to said profiles.

7. The turbine blade airfoil of claim 1, further comprising a tip shroud on a tip of the blade airfoil, and a gusset/fillet between the blade airfoil the tip shroud, the gusset/fillet comprising a planar diagonal surface over most of a diagonal bracing area thereof, and two planar side facets, wherein the diagonal surface and side facets merge with the blade airfoil via a continuous fillet.

* * * * *